United States Patent [19]

Grundy

[11] 4,005,837

[45] Feb. 1, 1977

[54] CIRCUIT ARRANGEMENT FOR CONTROLLING THE PROPULSION, BRAKING AND STATION STOPPING FUNCTION FOR A RAPID TRANSIT TRAIN

[75] Inventor: Reed H. Grundy, Murrysville, Pa.

[73] Assignee: Westinghouse Air Brake Company, Pittsburgh, Pa.

[22] Filed: May 27, 1975

[21] Appl. No.: 581,219

[52] U.S. Cl. ..... 246/182 B; 104/149; 235/150.24; 246/187 R

[51] Int. Cl.[2] ..... B61L 3/16

[58] Field of Search ..... 104/149; 235/150.2, 235/150.24; 246/63 C, 167 R, 182 R, 182 B, 182 C, 187 R, 187 B

[56] References Cited

UNITED STATES PATENTS

| | | | |
|---|---|---|---|
| 3,363,096 | 1/1968 | Hughson et al. | 246/182 B X |
| 3,395,275 | 7/1968 | Baughman | 246/187 R |
| 3,538,325 | 11/1970 | Smith et al. | 246/187 A X |

*Primary Examiner*—Stephen G. Kunin
*Attorney, Agent, or Firm*—J. B. Sotak; R. W. McIntire, Jr.

[57] ABSTRACT

A propulsion, braking, and station stopping control circuit for a rapid transit train including a first summing and amplifying apparatus for producing a velocity signal which is a function of the desired and actual velocity of the train and including a second summing and amplifying apparatus for producing a propulsion error signal which is a function of the velocity signal and an actual acceleration signal. An absolute value and sign determining apparatus for receiving the propulsion error signal and for producing an up-down signal which is to be supplied to an advanced train line register and propulsion train line encoder and for producing an analog signal which is supplied to a clock for generating pulses which are applied to the advanced train line register. Apparatus for producing a speed control braking error signal which is a function of the velocity signal and an actual acceleration signal. First gate apparatus for applying the speed control error signal to an output amplifying apparatus which provides a brake error signal to a train line wire driver. Third summing apparatus for producing a station stop brake error signal which is a function of the actual acceleration and calculated deceleration signals. Second gating apparatus for receiving the station stop brake error signal and comparing apparatus for enabling the second gating apparatus when the calculated deceleration and desired acceleration signals are equal so that the station stop brake error signal is applied to the output amplifying apparatus for providing a brake error signal on the train line wire driver.

10 Claims, 2 Drawing Figures

CIRCUIT ARRANGEMENT FOR CONTROLLING THE PROPULSION, BRAKING AND STATION STOPPING FUNCTION FOR A RAPID TRANSIT TRAIN

FIELD OF THE INVENTION

This invention relates to a circuit arrangement for controlling the movement of rapid transit vehicles, and, more particularly, to a propulsion, braking and station stopping control circuit for accelerating, decelerating, and stopping at a station a guided type of rapid transit train.

RELATED APPLICATIONS

Reference is made to the following copending U.S. applications, all having the same assignee and filed the same date as the present application:

1. Ser. No. 581,220, filed by R. H. Grundy for An Electronic Absolute Value and Sign Determining Circuit.
2. Ser. No. 581,224, filed by R. H. Grundy and J. J. Pierro for Propulsion Train Line Encoder for a Train Speed Regulation System.
3. Ser. No. 581,369, filed by R. H. Grundy for a Station Stop and Speed Regulation System for Trains.
4. Ser. No. 581,222, filed by R. H. Grundy for a Most Restrictive Digital to Analog Converter.

BACKGROUND OF THE INVENTION

In prior art technology, it is common practice to utilize a parallel-series tractive effort control system for regulating the speed of a rapid transit train. In the present arrangement, the four propulsion motors and associated control resistors on each car of a train are initially connected in series across the power source. To increase power and therefore speed, the control resistors are cut out in steps and then the motor field energy is weakened. Following this, the motors are switched to a parallel-series combination, normally with parallel pairs of motors connected in series across the power source with the same control resistors. Once again, each resistor is cut out in steps and then the motor fields are weakened, all of this increasing the speed of the train. Obviously, a reverse order of these stepping actions occurs when the train speed is being decreased gradually, although a complete shutoff of the propulsion motors is always possible. Originally, and still existing in some rapid transit systems, the motorman or train operator manually controls the train speed from a single position in the lead car using switching contactor apparatus. Each car of the train is controlled simultaneously to the same propulsion condition or level through train line wires running the length of the train and automatically connected from car to car when the cars are coupled together to form the train. Subsequently, a variable control of propulsion effort was developed in which variations of the propulsion level exist throughout the train. In other words, the levels of propulsion effort on each car is controlled semi-independently of the level existing on other cars of the train, such as, for example, cutting out the propulsion motors of every other car to reduce the total tractive effort. However, an even more sophisticated variable control arrangement is desirable for automatic train operation. For example, it is desirable that each car individually advance to the next higher power state than that called for by the train line control, with this propulsion advance stepped car by car from the leading car to the last car of the train. The converse of such variable operation applies when the propulsion levels are being decreased to reduce the speed of the train. This car by car stepping of propulsion level requires a separate advance train line control channel as well as an interlock to transfer each step by step cycle completion to the normal propulsion train line apparatus. At the same time, the propulsion train line requires an encoder to convert each advance train line cycle completion signal to a new train line condition. The arrangement must also include interface and/or coordination apparatus to coordinate the variable propulsion control with the train brake control. Automatic train operation also requires a station stopping control arrangement which responds to wayside actuation and interfaces the brake and station stopping with the propulsion controls by incorporating means for sensing and signaling the need for changes. In other words, the velocity error detection between the desired and actual speeds of the train is necessary to provide the various interlock interface controls required to coordinate station stopping with the vehicle brake and propulsion control.

OBJECTS OF THE INVENTION

Accordingly, an object of this invention is an improved propulsion, braking and station stopping control circuit for trains having a variable propulsion control arrangement.

Another object of this invention is to provide a unique control circuit for trains having an improved variable propulsion control arrangement which is coordinated with the braking control apparatus to inhibit the normal braking action while the speed is still being regulated by the propulsion apparatus.

Yet another object of this invention is a station stop and speed regulation system with an improved propulsion control circuit arrangement coordinated with the braking control apparatus and station stop control means.

A further object of this invention is a propulsion, braking and station stop circuit arrangement associated with an advance train line apparatus and a propulsion train line encoder means to control the movement of a rapid transit train.

A yet further object of this invention is to provide a circuit arrangement for rapid transit trains to coordinate operation between the braking, station stop, and variable propulsion control apparatus.

It is also an object of this invention to provide a propulsion braking and station stopping control circuit for rapid transit trains which varies the tractive effort to either increase or decrease speed in preselected steps through the entire range of propulsion power and coordinates with brake control to inhibit braking effort while the propulsion level remains greater than zero.

Still another object of the invention is a circuit arrangement for rapid transit trains to control the propulsion effort and braking effort during station stop operations and during normal operation.

A further object of the invention is a propulsion and brake and station stopping circuit arrangement control for rapid transit trains to cause an increase or decrease in the total propulsion of the train in single car steps to the next level, to periodically shift the base propulsion level from which the advance train line changes are made, to detect any difference between actual and desired speeds, drive the advance train line apparatus, and control braking effort to coordinate propulsion and braking applications to eliminate overlap.

A still further object of the invention is a propulsion, braking and station stopping interface circuit for rapid transit trains responsive to wayside markers to reduce the train propulsion level in predetermined steps and activate the brake control apparatus to stop the train at a preselected position at the next station.

Other objects, features, and advantages of this invention will become apparent from the following specification and appended claims when taken in connection with the accompanying drawings.

SUMMARY OF THE INVENTION

In practicing this invention, the general philosophy or action in controlling the train speed through varying the propulsion level or braking effort is as follows. With all cars of the train at the same base propulsion level and a speed increase desired, the first car is advanced by the advance train line apparatus to the next higher power state, for example, from the coast condition to the "switch" condition (power state 1), with the other cars remaining in the original or base level propulsion condition. Then the second car is advanced to the same higher propulsion level. This single car shift is repeated if necessary until the entire train is in the next higher propulsion level. At this time, a hold signal is sent throughout the train and the advance train line signal which advanced the cars to the next higher state is reduced to zero. The hold signal retains the propulsion effort until the nearly simultaneous energization of the propulsion train line for this next higher level occurs. After this has been accomplished, the train is free to once again advance, car by car, to the next higher power state. A decrease in tractive effort is a retrogression of the same chain of events. The advance train line channel and encoder apparatus is thus a scheme whereby an analog voltage is passed down the train to each successive car. Each car operates an advance relay when the voltage input is higher than a preselected level. Each car then retransmits the received voltage minus a selected voltage to the next successive car. For specific example, in one system the advance relay in each car is energized and acts only if the input voltage is higher than 6 volts and each car subtracts twelve volts before transmitting the voltage to the next car. Thus, as the voltage transmitted from the first car is stepped successfully to higher values, the necessary operating voltage is transmitted to successive cars to actuate them in a sequential manner towards the rear of the train.

The advance train line arrangement is stepped by clock pulses which are initiated by the propulsion, braking and station stopping control circuit and are developed in accordance with a velocity or propulsion error signal. In the propulsion operating mode, signals representing the desired speed and the actual speed measurements are applied to summing, amplifying and comparing networks to produce a single analog propulsion error signal. The sign of the propulsion error is derived from an op-amp comparator to produce an up/down signal which signifies the over or under speed condition and thus determines whether power should be decreased or increased, respectively. The absolute value of the analog error signal is converted into a digital signal to provide the clock pulses for driving the advance train line register, the frequency being determined by the magnitude of analog error signal as converted into digital form. When the advanced train line apparatus has completed a cycle, that is, all cars have been shifted to the next higher or lower level as selected, the apparatus generates and transmits a clock pulse to the propulsion train line encoder. Also, when all of the cars have been advanced or retarded to the next adjacent power condition, a hold wire is energized which freezes the train line relays to the last condition called for by the advance train line register until the propulsion train line encoder has responded to clock pulse. At this time, the advanced train line is returned to the opposite condition to prepare for further variation of the propulsion level.

The propulsion train line encoder establishes an existing base propulsion level of the tractive effort of the train, that is, all cars at the same propulsion state. The clock pulse from the advanced train line register actuates the propulsion train line encoder up or down, as required, one full state of propulsion level. This operation of the propulsion train line encoder increases or decreases the base propulsion level to the next higher or lower level by energizing the train line relay corresponding to the base level of propulsion now established and also the train line relays for all lower levels. The speed error signal and a multiple actual acceleration signal form a speed control braking error signal which acts on the brake control apparatus but a clamping element inhibits its application, so that the brakes are held released any time that the train line arrangement is established at a base propulsion level above zero. This is done in order to inhibit braking while speed regulation may be accomplished by a variation in the propulsion level only. When a zero and down signal is applied to the clamping element, the speed control braking error signal is permitted to pass through a timing and gating network to the input of an output op-amp amplifier. The brake error output of the op-amp amplifier deactivates a brake relay through a comparator-driver circuit and initiates a braking effort through the "P" or train line wire driver.

A station stopping control apparatus is incorporated into the system and interfaced for coordination with the propulsion and brake control circuits. Station stopping apparatus is responsive to each of three trigger coils accurately located, with respect to a station platform, along the approach track. It is then the function of the station stopping apparatus to transform these trigger signals and the speed measuring tachometer pulses into an accurate positioning of the train at the platform with a comfortable deceleration from operating speed to the station stop. In considering the operation for stopping a train, the accuracy of the stop divided by the distance over which the stop must be made determines the accuracy to which calculations must be made. When this is considered along with such criteria as a square root involved in the calculations and a variable input voltage, it is apparent that a one-trigger stop is not feasible. In order to maintain accuracy, it is therefore necessary to update the speed and distance one or two times at additional trigger coil locations during the station stop program so that the accumulated error may be reset to zero. During resets, the equipment again restarts its calculations with regard to stopping at a new and higher resolution which also allows full use of the voltage swing limits within the source. For this reason, the station stop circuit employs a rescaling technique which is accomplished at each of the three trigger points. As the trigger impulses are received, a rescale element rescales the calculations by increasing the apparent tachometer frequency and by altering the gain of a variable amplifier which is used to scale the actual velocity signal. The tach frequency, after division, is counted and fed to a digital to analog converter which converts the tach pulses into a voltage proportional to the distance from the stopping point.

The rescaled actual velocity signal and the distance signal are then fed into an acceleration computer which calculates the product of the velocity squared divided by the twice the distance. This product represents the deceleration rate necessary in order to stop at the station platform. As the train continues towards the station without any deceleration, this product becomes larger since a higher deceleration rate is necessary as the application of the brakes is delayed. When this calculated deceleration product closely approaches a selected desired deceleration rate, the advance train line and propulsion train line apparatus are driven through a comparator-gate network to reduce the train propulsion level to zero. When the required deceleration equals the desired deceleration rate, a comparator is actuated which allows a station stop brake error signal which is the sum of the actual deceleration and calculated deceleration to flow through a timer and gate network to the output amplifier. If the deceleration calculated to stop at the station begins to exceed the actual deceleration, the difference will increase, which, multiplied by the gain of an amplifier, will cause a signal to the control line to apply the brakes in order to rebalance the actual deceleration with the calculated value.

It will be apparent that this arrangement is then a "rate wild system," in that the deceleration rate which the train maintains during a station stop is not fixed but is free to vary in accordance with the conditions. For example, when a wayside trigger signal is received, there is always a possibility that the station stop profile was in error. The reception of this signal will cause a reset of the distance circuit and rescaling of the velocity such that the calculated deceleration signal will take a step function, either plus or minus in accordance with the direction of the error, which will then be fed into the brake system also by a step function. However, due to delay, the brake system will not begin to react immediately, so that the calculated deceleration will tend to increase. Once the brakes are applied, then the actual deceleration will begin to balance the calculated value which, due to the time delay, will cause a reduction in the calculated value. Thus, the final deceleration rate that the train uses for the station stop will lie somewhere between the original value of the calculated deceleration and the value which is attained at the rescale point. It can be seen then that the apparatus converges the actual deceleration and calculated deceleration signals to a value midway between the two every time a system disturbance causes a separation.

BRIEF DESCRIPTION OF THE DRAWINGS

Other objects, features, and advantages of this invention will become more apparent from the following detailed description of the preferred embodiment when considered in conjunction with the accompanying drawing, wherein.

DETAILED DESCRIPTION OF THE ILLUSTRATED EMBODIMENT

Figure 1A:
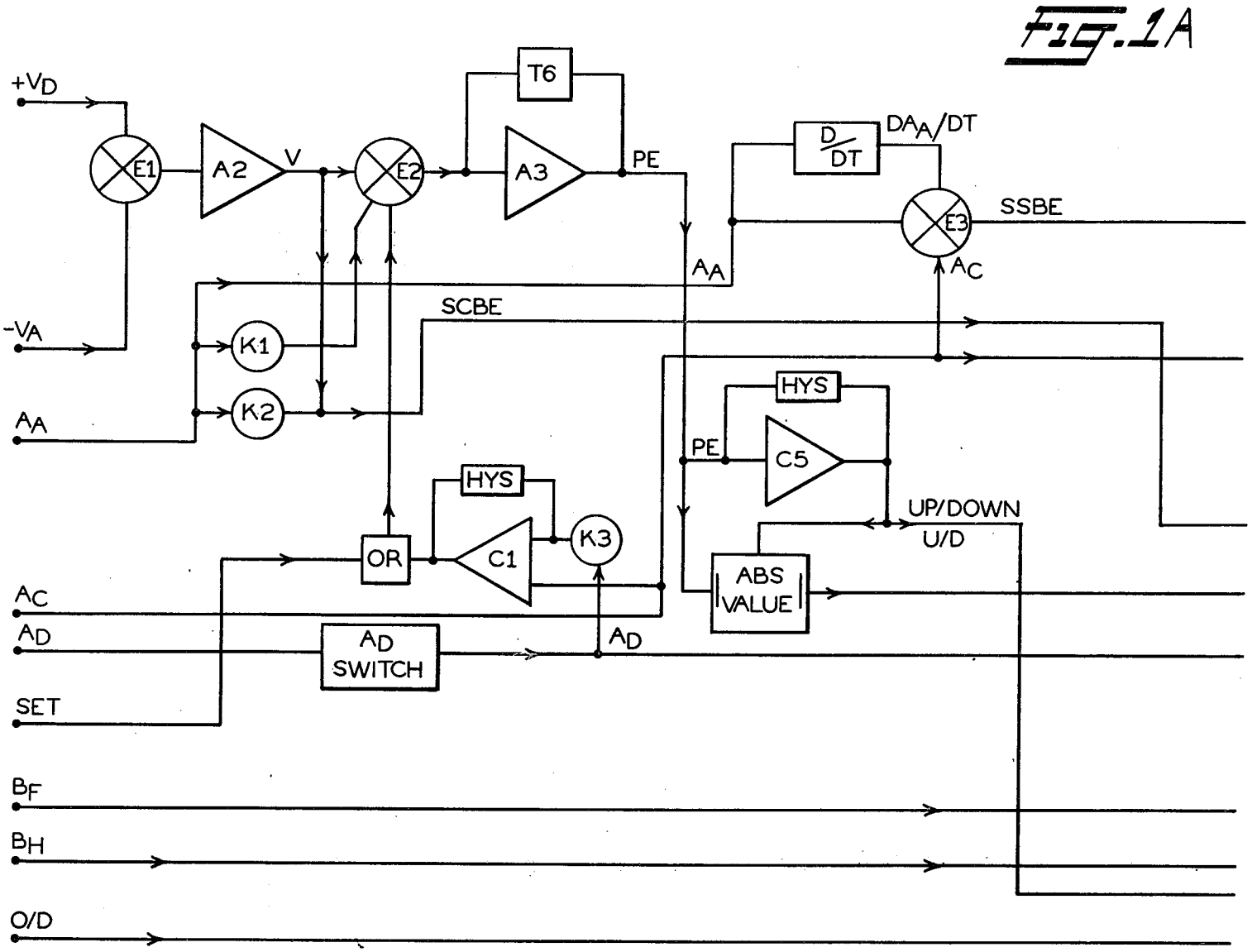
FIGS. 1A and 1B, when placed side by side, are a preferred embodiment of the propulsion, braking and station stopping circuit arrangement wherein the components or elements are illustrated in the drawings by schematic block diagrams in which conventional logic symbols are used where appropriate. Otherwise, labeled blocks are used to designate the required circuit components or apparatus. The specific circuits are not critical, as any suitable logic elements and circuitry to perform the designated function may be utilized in practicing the invention. Normally, solid state circuit elements, preferably of the integrated circuit type, will be used, but the invention is not limited to this arrangement or style of circuit elements.
Figure 1B:
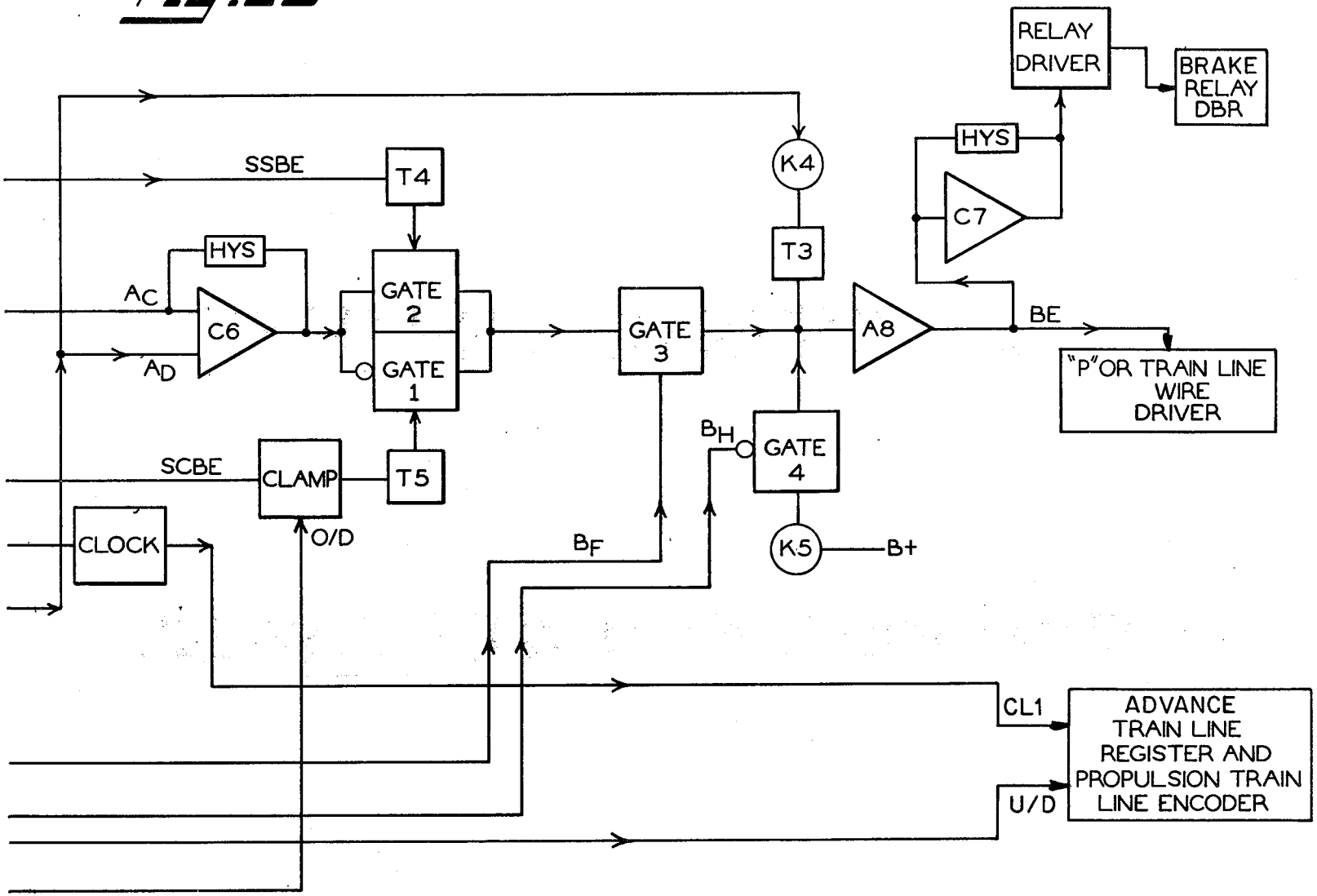

Referring now to FIGS. 1A and 1B of the drawings, it will be understood that the velocity or speed command functions are controlled by either a master control which is under the direction or supervision of the train operator or motorman or by a cab signal system which develops the desired speed signal in accordance with the traffic conditions ahead of the train. The master control and the cab signal inputs are fed into a speed limit desired velocity element or system component, entitle "Most Restrictive Digital to Analog Converter," the circuit details and specific operation of which are described in my above-cited copending application Ser. No. 581,220 which forms no part of the present invention, and, therefore, the circuitry and its operation are not repeated herein. Briefly, this speed limit desired velocity unit selects the minimum or most restrictive one of the two input speed signals and converts it to a first analog voltage output designated as the desired velocity speed $V_D$. As shown, the desired velocity signal $V_D$ is a positive voltage which is fed to a summing junction point El. Also, a second analog voltage proportional to the actual train velocity $V_A$ is derived from a suitable train speed measuring means such as an axle-driven pulse producing tachometer. The tachometer pulses are supplied to a generator which, by means of digital logic circuitry (not shown), produces a signal by timing-on a first clock pulse after the reception of a tach pulse and timing-off after the reception of the next clock pulse. This produces a constant width pulse, one clock period wide, which is used to switch the variable tachometer voltage through an amplifier where it is averaged, with modification by the wheel wear switch, to give a smooth direct current signal proportional to speed $V_A$. The signal $V_A$ is also differentiated by a suitable differentiating circuit to produce a time differential of signal $V_A$ which is the actual acceleration of the train, designated as signal $A_A$, as will be described hereinafter.

The actual train velocity $V_A$, which is a negative voltage, is also applied to the summing junction point El. After the two velocity signals $V_D$ and $V_A$ are summed at point El, they are applied to the inverting input of an integrated circuit operational amplifier A2. The amplifier A2 includes a non-inverting input which is resistively coupled to a reference potential and a portion of the output is fed back to the inverting input terminal via a feedback resistor. The signals are compared and multiplied by amplifier A2 so that the output is a velocity error signal V which is scaled to either one or more tenths of a volt per mile per hour. For example, in one specific installation, signal V is scaled to 0.1 volt per mph error. Since the propulsion and brake have different transmission delays and time constants, it is necessary to split signal V into two different paths or loops. Also, for purposes of control, it is advisable to add to the velocity signal V of both paths selected amounts of acceleration feedback using signal $A_A$. Since the brake system is different from the propulsion system, two different ratios $A_A/V_A$ are necessary for these two circuits. Thus, the signal $A_A$ is fed through two different multiplying factors K1 and K2, each associated with a different loop circuit. The multiplier K1 includes a diode connected across one of a pair of series-connected resistors, while the multiplier K2 simply includes a pair of resistors. The signal $A_A$, which is multiplied by factor K1, is used with the propulsion loop and is summed with the velocity signal V at summing junction point E2. The sum is then multiplied by an integrated circuit operational amplifier A3 with its associated time constant T6. That is, the sum of the velocity signal V and the signal $A_A$ is applied to the inverting input terminal of the amplifier A3. The non-inverting input terminal is resistively coupled to the referenced potential, and a parallel timing network including a resistor and capacitor is connected from the output to the inverting input of the amplifier A3. Signal $A_A$, multiplied by factor K2, is joined with signal V in another branch to produce a speed control brake error signal SCBE, which will be further discussed later.

The output of amplifier A3 is a propulsion error signal $P_E$ which is then fed into a comparator C5 which has a small amount of hysteresis, as designated by the block designated HYS. The comparator C5 is an integrated circuit operational amplifier which is the counterpart of the OP-AMP-2 and the amplifying circuit including transistor Q2 of the above-noted application Ser. No. 581,369. The function of comparator C5 is to determine the sign of the error signal. If the propulsion error is positive, then the train is going too fast and a reduction in tractive effort is needed. Since signal $P_E$ ultimately becomes a clock frequency which is fed to an appropriate register, it is important whether the register counts up or down. This is a function of the sign of the propulsion error. Thus, it will be seen that the output of comparator C5 is used to drive an UP/-DOWN line as indicated by the reference U/D, which is used by the digital logic as described in application Ser. No. 581,369 which forms no part of the present invention. In another function, comparator C5 forms part of the circuitry to generate an absolute value which is necessary because the clock, which is in this case an analog to digital (A/D) converter or interface circuit of the type shown described in my copending U.S. application Ser. No. 548,424, filed Feb. 5, 1975, does not respond to bi-directional signals. The output of the absolute value circuit, which is illustrated by the conventional block designated |ABS VALUE|, the counterpart of the OP-AMP-1 which is toggled by the switching transistor Q1 of the application Ser. No. 581,226, is a voltage which is always negative in polarity and is proportional to the propulsion error. The clock input is fed from a resistor divider network which generates a non-linearity in the clock output frequency with regard to the input error. This non-linearity is designed to produce an increase in clock rate as the error magnitude increases from the set point. The clock, which is illustrated by a conventional block so designated, also possesses a dead band response as noted in application Ser. No. 548,424. If the error signal $P_E$ is within this dead band range, the clock will not operate at all. The output of the clock is normally a series of periodic pulses, at the selected frequency, designated by the reference character CL1.

The output pulses CL1 and the signal on the U/D line are then fed, in the normal loop progression, to the advance train line (ATL) regeister, as shown in FIG. 5 of and described in the specification of application Ser. No. 581,369. The function of the ATL register is to advance or retard the propulsion level of the cars one by one in a vernier manner and thus control the train speed by small additions or subtractions of the tractive effort as more fully described in application Ser. No. 581,369.

When a decrease in tractive effort is called for, the up/down or U/D line changes to a down condition signal and the registers proceed to retrogress down to zero level as described in application Ser. No. 581,369. If the speed reduction is such that braking is required, the propulsion train line register will eventually reach a zero condition, in which a coast relay will be deenergized and drop out. When this occurs, the COAST train line wire is deenergized, thus preventing the advance train line signals from picking up a relay to cause a train to respond to any propulsion command. For this reason, the at-rest state of the system is with the advance train line register fully advanced to its highest condition and the propulsion train line register at its lowest or zero state. When the propulsion train register is in the zero condition and a down counting state exists on line U/D, a signal is generated by a "0" & DOWN LOGIC element of the propulsion train line encoder which is supplied over the "0" & DOWN line O/D.

The O/D signal is used, for example, to prevent cycling by the advance train line register so that the advance train line relays are not cycled during the braking portion of the speed regulation. The O/D signal is also supplied to clamping circuit, as is illustrated by the conventional block labeled CLAMP which is supplied with the speed control brake error signal SCBE. In practice, the clamp includes a switching transistor which is cut off to back bias a diode when the O/D signal is present. Hence, once this clamp is removed, the velocity error signal, as derived by the sum of the outputs of multiplier K2 and amplifier A2, is allowed to flow through timer T5 and gates 1 and 3 to amplifier A8. The timer 5 is a capacitor which provides a time constant when the diode is reversed biased. The gates 1 and 3 are conventional logic elements, while amplifier 8 is a non-inverting type of integrated circuit operational amplifier. The output of amplifier A8 is designated as the brake error signal BE which is normally a slightly negative voltage. However, when this signal goes to a positive voltage upon the removal of the clamp, thus indicating a request for braking effort, comparator C7 deenergizes a braking relay DBR through the illustrated relay driver element. The comparator 7 is an integrated circuit operational amplifier having an inverting and non-inverting input and an output coupled to a transistorized driving stage via a series-connected resistor and Zener diode. Signal BE is also fed to the "P" train line wire driver which begins to apply brakes by lowering the current in the train line P from it normal release value. This O/D clamp is provided because, whenever a decrease in train speed is obtainable through a reduction in propulsion only, some means is necessary to inhibit the brakes from being applied, as would be the case since a brake error voltage SCBE exists under such conditions.

Considering now the station stopping procedures, it has been previously described that in order to initiate a station stop operation, it is necessary to receive a trigger signal from the wayside actuating means over the pick-up coil shown and described in FIG. 3 of above noted application Ser. No. 581,365. In practice, the wayside means or device is positioned a predetermined distance in approach to the station platform. The received trigger signal is fed through a suitable decoder element to the trigger detection circuit in the RESCALE component which then feeds a series of logic elements such as an appropriate memory unit. It has also been previously mentioned that in order to reduce the effect of errors in the operation and to increase the accuracy of the station stop, more than one trigger signal, that is, more than one wayside actuating device, must be used. In one specific instant, three such wayside devices are utilized, each a different preselected distance in approach to the station. Under this operation, the signal produced in the pick-up coil from the first wayside device, after decoding in the first decode element, provides a first signal into the corresponding trigger detection element and thence into the memory unit. The trigger signal developed in the pick-up coil upon passage of the second and third wayside devices is passed to a second decoding element and thence provides, respectively, the second and third signals which are passed through another trigger element into the memory unit.

The resulting output from the memory unit upon registry of the first trigger signal causes the station stop mode line SSM to apply a high level signal to the acceleration computer component shown in FIG. 4 of application Ser. No. 581,369, indicating that it is now in the station stop mode. This high level signal and two other signals are used to effect a station stop. The latter two signals are the tachometer input frequency which is corrected for wheel wear and the actual velocity signal $V_A$, from the speed measuring means, which is also corrected for wheel wear. Since the tachometer generates a pulse for each revolution of the axle, each pulse therefore represents a unit of distance traveled, i.e., the circumference of the wheels. When corrected for wheel wear, the totalized pulses are a measure of total distance traveled, e.g., beyond the wayside trigger device. These input signals are altered in frequency to different degrees and amplitude, respectively, depending upon which of the three trigger signals has been received. Signal $V_A$ is applied to the input of a variable gain amplifier, while the wear corrected tachometer frequency signal is applied to one input of a frequency divider element as described in application Ser. No. 581,369. If the first trigger signal has just been received, the memory output sets the gain of a selected amplifier to its lowest value, while a frequency divider, which divides corrected tachometer frequency signal into a sealed signal, is set at its highest divisor value. At subsequent triggers, selected amplifier is increased in gain while the frequency division is decreased so that, at the last or third trigger, corrected tachometer frequency signal is equal to scaled signal. The scaled signal is transmitted through an appropriate gate, which is enabled (the circuit completed) by the high level signal on line SSM to the instance register element which is a totalizer of the scaled tachometer pulses. The output of the distance register is then fed to a digital to analog converter which converts the totalized tachometer signals into an analog signal of distance, actually distance-to-go to the station stop. This distance signal is set at a preselected voltage level and then decreases linearly towards zero as the train approaches the stopping point.

Due to the fact that the final three feet, for example, of the station stop operation are made open loop, it is necessary to multiply the distance signal by a difference gain after reception of the third trigger signal. This is the reason for the variable gain amplifier A5 inserted in the output between the D/A converter and the Acceleration Compute element of the Acceleration Computer block as shown and described in application Ser. No. 581,369. The gain of another selected amplifier is controlled over the distance reset line from a rescale component in accordance with the trigger signal recorded in the memory unit. A distance-to-go signal, as output from the another selected amplifier, is finally divided into the square of a scaled velocity signal, in accordance with the ratio shown within the acceleration compute element. The result is an acceleration signal, actually the instantaneous deceleration rate $A_C$ necessary to stop the train at the station from its present position and speed.

When the train is nearing the station platform and is proceeding at a very low rate, for example, less than 3 mph, the filter circuits in the velocity and acceleration components have difficulty filtering the analog signals which cause rather large disturbances in the deceleration signal $A_C$. For this reason, at approximately 6 feet from the stopping point, the entire system is forced into an open loop operational mode by a high level signal on the brake flare line $B_F$. This brake flare signal is actuated by the distance circuit when it reaches what appears to be three feet but in reality is six feet from the station stopping point. Following this brake flare signal, the brakes will be governed in an open loop manner which will be described shortly. When the doors are opened at the platform, the brake flare signal $B_F$ remains at high level and the brake holding signal $B_H$ also goes to a high level. This latter signal is used to actuate a holding brake application for a purpose to be described shortly. If all of these foregoing actions have proceeded in the proper order, then when the train doors are closed at the completion of the station stop and the ATO starting device is actuated, the application of this GO signal to a pulse generator element located in the Acceleration Computer block of application Ser. No. 581,369 actuates a program reset signal to a high level which resets the memory unit, taking the station stop system out of the station stop mode and retains it in a clamped state waiting for the next wayside trigger input.

Since a station stop command is very likely to occur during the time that a train is being regulated by the propulsion control system, some arrangement for a smooth transition from propulsion to braking must be provided. This is achieved by feeding the calculated deceleration signal $A_C$ into a comparator element C1. The comparator includes an integrated operational amplifier having an inveting and non-inverting input and an output. The operational amplifier comparator C1 includes a series connected resistor and diode coupled between the output and non-inverting input to provide hysteresis as designated by the block marked HYS. The calculated deceleration signal HC is applied to the non-inverting input and is compared with approximately 90% of the desired acceleration/deceleration signal $A_D$ which is applied to the inverting input.

This latter signal is provided from an element designated as the $A_D$ Switch and is preset in accordance with the desired operating conditions of the transit system to provide comfortable acceleration and deceleration for the passengers. Whenever the signal $A_C$ reaches 90% of the value of signal $A_D$, the output of comparator C1 is applied, through an OR gate to summing circuit E2 and thence to amplifier A3, overriding all other inputs to drive down the propulsion effort into a coast condition. It is important to note that the output of comparator C1 only affects the propulsion portion of the speed regulation arrangement and not the braking portion. Thus, a true coast condition can be maintained until signal $A_C$ approaches signal $A_D$, causing initiation of the stopping action itself.

Signals $A_C$ and $A_D$ are both also applied to a comparator element C6. Again the comparator C6 includes an integrated operational amplifier having an inverting and a non-inverting input and an output. The signals $A_D$ are applied to the inverting input, and the signals $A_C$ are applied to the non-inverting input. A series-connected resistor and diode is coupled from the output to the non-inverting input to provide hysteresis as indicated by the block marded HYS. When these two signals are equal, the output of comparator C6 inhibits or interrupts the circuit through previously mentioned gate 1 and enables or completes the circuit through gate 2 which is similar to but the inverse of gate 1. Thus, the signal that is now fed through timing network T4, gate 1 and gate 3 to amplifier A8 is the difference between signals $A_A$ and $A_C$ as produced in the summing junction E3, i.e., the Station Stop Brake Error signal SSBE. As previously described, if the calculated deceleration exceeds the actual deceleration, then a positive error exists which will cause amplifier A8 to increase its output which is the braking error signal BE. Also as previously described, this increases the amount of braking effort by the "P" line driver and, through comparator C7, causes relay DBR to release. When the train reaches the 6-feet-to-go mark, the brake flare signal $B_F$ goes to a high level which inhibits gate 3. The interruption of this gate disconnects all previously described signals from amplifier A8, which is a high input impedance amplifier. The only input now fed to amplifier A8 is the desired acceleration signal $A_D$ which passes through the multiplier or attenuator K4 and the timing network T3. This input to amplifier A8 slowly rises to a value necessary for the smooth slowdown of the train, which rise is governed by the time constant T3. The impedance under these conditions is sufficiently high that normally during propulsion or station stopping operations, it is overridden by the signal generated in the usual propulsion or station stopping circuitry and applied through gate 3. When the train doors are open, the brake holding signal $B_H$ goes to a high level which causes gate 4 to clamp the input of amplifier A8 to a level determined by the B voltage and multiplier K5 that is necessary to maintain a preselected brake service pressure, for example, a half service pressure.

While the train is sitting at the station, the propulsion or speed control circuitry will normally be trying to satisfy the input speed command. In order to prevent this, a signal actuated by the train operator is applied to the SET line which causes the propulsion circuitry to maintain a zero and down state. When the start command is actuated, the GO signal causes the SET signal to disappear, thus resetting the station stop circuitry and permitting the propulsion circuitry to advance to the desired speed.

The propulsion, braking, station stop circuit arrangement of this invention thus provides an interfaced and coordinated control arrangement for a rapid transit train to regulate its propulsion and braking efforts with an incorporated station stop program. Speed regulation is achieved in a finely variable manner through the use of an advance train line control arrangement which steps the propulsion effort up or down, car by car, to either increase or decrease train speed, from a base propulsion level established by the usual propulsion train line control. The propulsion train line encoder apparatus responds to the completion of each cycle of ATL operation to shift to a new base level of propulsion with the ATL apparatus then reset to continue its variable control. Braking effort is inhibited while any propulsion effort exists in order to allow speed regulation by propulsion control only, as possible. The braking effort is initiated when the propulsion train line encoder reaches its lowest level while in a count-down condition, that is, less than the coasting speed. The station stop program is initiated by the reception of a wayside trigger signal which designates a preselected stopping distance. The trigger signal initiates the stopping program which calculates the deceleration rate required to achieve an accurate station stop. This program is rescaled to increase its accuracy at successive trigger locations in approach to the same station. The program is also coordinated with the speed regulation apparatus to slow the train by reduced propulsion effort until the required deceleration rate matches the level at which braking is required. The complete system of my invention thus functions in an efficient manner to achieve the desired results with the minimum apparatus to provide an economical arrangement.

While there has been shown and described but a single specific illustration of a propulsion, braking, and station stop circuit arrangement for rapid transit trains embodying this invention, it is to be understood that various changes, modifications, and alterations may be made therein within the scope of the appended claims without departing from the spirit and scope of this invention.

Having now described the invention what I claim as new and desire to secure by Letters Patent is:

1. A circuit arrangement for controlling the propulsion, braking, and station stopping function for a rapid transit train comprising, a first summing and amplifying means for producing a velocity signal which is a function of the desired and actual velocity of the train, a second summing and amplifying means for producing a propulsion error signal which is a function of the velocity signal and an actual acceleration signal, an absolute value and sign determining means for receiving the propulsion error signal and for producing an up-down signal and for producing an analog signal which is supplied to a clock for generating pulses, means for producing a speed control braking error signal which is a function of the velocity signal and an actual acceleration signal, first gate means for applying the speed control braking error signal to an output amplifying means which provides a brake error signal to a train line wire driver, third summing means for producing a station stop brake error signal which is a function of actual acceleration and calculated deceleration signals, second gating means for receiving the station stop brake error signal, and comparing means for enabling said second gating means when calculated deceleration and desired acceleration signals are equal so that the station stop brake error signal is applied to said output amplifying means for providing a brake error signal on the train line wire driver.

2. The circuit arrangement as defined in claim 1, wherein a clamping network enables said first gating means for passing the speed control brake error signal to said output amplifying means.

3. The circuit arrangement as defined in claim 1, wherein said absolute value and signal determining means includes a comparator means.

4. The circuit arrangement as defined in claim 1, wherein said absolute value and sign determining means includes a integrated circuit operational amplifier.

5. The circuit arrangement as defined in claim 1, wherein a first multiplying means adds a select factor to the actual acceleration signal that is combined with the velocity signal to produce the propulsion error signal.

6. The circuit arrangement as defined in claim 1, wherein a second multiplying means adds a select factor to the actual acceleration signal that is combined with the velocity signal to produce the speed control brake error signal.

7. The circuit arrangement as defined in claim 1, wherein a comparator and a relay driver means is coupled to the output amplifying means to deenergize a brake relay when the output amplifying means receives a speed control brake error signal or a station stop brake error signal.

8. The circuit arrangement as defined in claim 1, wherein a multiplier and comparator receive the desired and calculated acceleration signals and enables an OR gate which causes the velocity signal and actual acceleration signal applied to the second summing means to be overridden to cause said second amplifying means to assume a coast condition.

9. The circuit arrangement as defined in claim 1, wherein a flare signal is applied to a third gating means to remove the station stop brake error signal from said output amplifying means when the train is given distance from the station.

10. The circuit arrangement as defined in claim 1, wherein a hold signal enables a fourth gating means to cause an input signal to be applied to said output amplifying means to cause a preselected brake service signal to be produced on the train line wire driver.

* * * * *